US007083026B2

(12) United States Patent
Cholinski et al.

(10) Patent No.: US 7,083,026 B2
(45) Date of Patent: Aug. 1, 2006

(54) ENGINE FRAME WITH COUNTER-ROLLER SUPPORT FOR AN ELEVATOR DRIVE

(75) Inventors: Andrzej Cholinski, Ebikon (CH); Heinrich Küttel, Weggis (CH)

(73) Assignee: Inventio AG, Hergiswil (CH)

( * ) Notice: Subject to any disclaimer, the term of this patent is extended or adjusted under 35 U.S.C. 154(b) by 543 days.

(21) Appl. No.: 10/361,992

(22) Filed: Feb. 10, 2003

(65) Prior Publication Data

US 2003/0155188 A1 Aug. 21, 2003

(30) Foreign Application Priority Data

Feb. 18, 2002 (EP) ..... 02405121

(51) Int. Cl.
*B66B 11/08* (2006.01)

(52) U.S. Cl. ..... 187/266; 187/251; 248/645; 248/678; 254/334; 254/335

(58) Field of Classification Search ..... 187/250, 187/251, 254, 266, 414; 248/637, 645, 676, 248/678, 680; 254/334, 335
See application file for complete search history.

(56) References Cited

U.S. PATENT DOCUMENTS 1,788,081 A * 1/1931 Brown ..... 248/645
4,842,101 A * 6/1989 Lamb ..... 187/266
5,035,300 A * 7/1991 Chapelain et al. ..... 187/266
5,957,242 A * 9/1999 Suter et al. ..... 187/266

FOREIGN PATENT DOCUMENTS

JP 54115849 A * 9/1979
JP 01122890 A * 5/1989
JP 06135666 A * 5/1994

* cited by examiner

*Primary Examiner*—Kathy Matecki
*Assistant Examiner*—Stefan H. Kruer
(74) *Attorney, Agent, or Firm*—Schweitzer Cornman Gross & Bondell LLP

(57) ABSTRACT

An engine frame and counter-roller support assembly provides for adjustable positioning of the support with respect to the engine frame, thus allowing differing cable-line spacing to be accommodated. The support includes a pair of carrier elements. The counter-roller is supported on an axle in the bore holes of the carrier elements. The carrier elements are identical and each are in the form of a plate with a headliner and reinforcement ribs. The headliner has a contact surface with a number of two-stage bore-holes which serve for the fastening of the counter-roller support to the engine frame. The bore-holes are arranged such that the counter-roller support can be fastened in different positions, according to the required cable-line spacing between cab cables and counterweight cables.

5 Claims, 4 Drawing Sheets

ENGINE FRAME WITH COUNTER-ROLLER SUPPORT FOR AN ELEVATOR DRIVE

The invention concerns an engine frame with counter-roller support for an elevator drive. The counter-roller support, consisting of carrier elements and counter roller being arranged on the engine frame, provides and maintains the necessary cable-line spacing between an elevator car and a counterweight.

BACKGROUND OF THE INVENTION

A gearless drive machine for elevators is known from the patent document EP 0 468 168 B1. In that gearless drive machine for elevators, a machine frame carries a bearing block and a shield block. A main shaft is mounted at two points on the output side by means of a free bearing arranged on the bearing block and by means of a fixed bearing arranged on the shield block. A traction sheave with a brake disc is provided between the bearing points. The traction sheave is firmly connected to the main shaft by means of a first clamping device. The bearing arrangement of the traction sheave on both sides permits large radial loads by small deformations of the main shaft. A hoist motor fed with alternating-current voltage consists of a stator and a rotor with a rotor hub, which can be pushed onto the main shaft. At the drive-side end of the main shaft, a second clamping device provides a fixed connection between the main shaft and the rotor hub. At the machine frame, which carries a bearing block and a shield block, is also a counter-roller support with a counter-roller which serves to keep a given cable-line spacing through the elevator car and counterweight as well as through the cable guide.

A disadvantage of such well-known mechanism lies is that, for a particular counter-roller support and counter-roller, the cable-line spacing is fixed. For a different cable-line spacing, different carrier elements are necessary. Bore-holes must be bored depending upon the specific construction of the elevator. The variety of possible variants entails high manufacturing costs. In addition, counter-roller must be mounted from the bottom, within the attendant difficulties associated with a range of concrete foundations.

BRIEF DESCRIPTION OF THE INVENTION

The present invention allows for accommodation of differing cable-line spacings. An elevator engine frame and counter-roller support assembly in accordance therewith has a counter-roller support including a pair of spaced identical carrier elements, the counter-roller is supported by the carrier elements, which are repositionable upon the engine frame. The carrier elements may be in the form of a plate with a headliner having multiple bore-holes to accommodate a mounting bolt. At least one corresponding bore-hole is provided in the engine frame, adjustment of the support on the frame being obtained through the particular alignment of the respective bore-holes. At least one additional bore-hole can be provided on the engine frame to further provide raster adjustment.

Among the advantages of the invention is that few vamounts of the carrier element are required. With the present invention, larger and thus more economical production runs can be accomplished, different cable-line spacings to be accommodated by a single form of construction. The degree of order-dependent work is thus lessened. In addition, the mounted-on construction for the counter-roller allows accessibility from above, the fastening bolts, being important for the security and safety of the elevator, are at all times accessible.

BRIEF DESCRIPTION OF THE DRAWINGS

The invention will be more fully understood upon review of the following detailed description, in association with the annexed drawings, wherein.

DETAILED DESCRIPTION OF THE INVENTION

Figure 1:
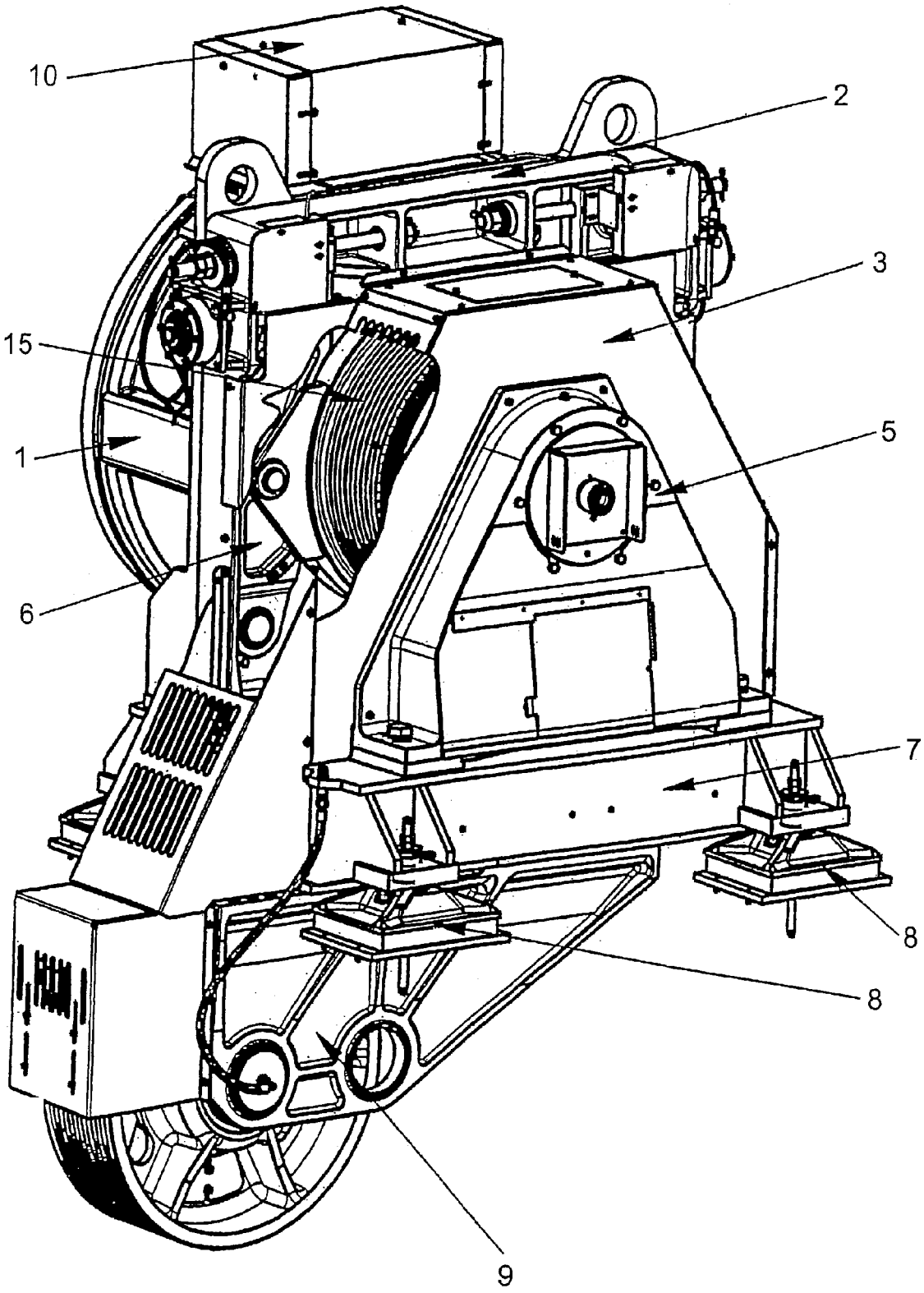
FIG. 1 is a perspective view of a drive unit of the invention with a counter-roller support.

FIG. 1 shows a finished and assembled drive unit, comprising an engine 1, an engine stand 2 serving as a first end shield, a bearing block 5 serving as a second end shield, a traction sheave 15 and a machine frame 7 with counter-roller support 9. The stator of the electric drive 1 is bolted by means of a flange, to the engine stand 2. The rotor of the electric drive 1 connected to a free end of a shaft (not shown) bearing the traction sheave 15; the shaft is mounted to the bearing block 5 and to the engine stand 2. The free shaft end extends beyond the engine stand 2. The traction sheave 15, which is visible through a broken-away section of cable protection casing 3, is mounted upon engine stand 2 and bearing block 5 by means of the shaft. A brake 6 is arranged at the inside face of the engine stand 2 and is protected by the casing 3. Depending upon the structure of the drive unit, the brake 6 can also be positioned at the inside face of the bearing block 5.

The engine stand 2 and the bearing block 5 are arranged on the machine frame 7, which has at each of its corners an adjustable supporting element 8. The counter-roller support 9 is arranged on the lower side of the machine frame 7. All electrical connections of the drive unit are in a terminal box 10.

Figure 2A:
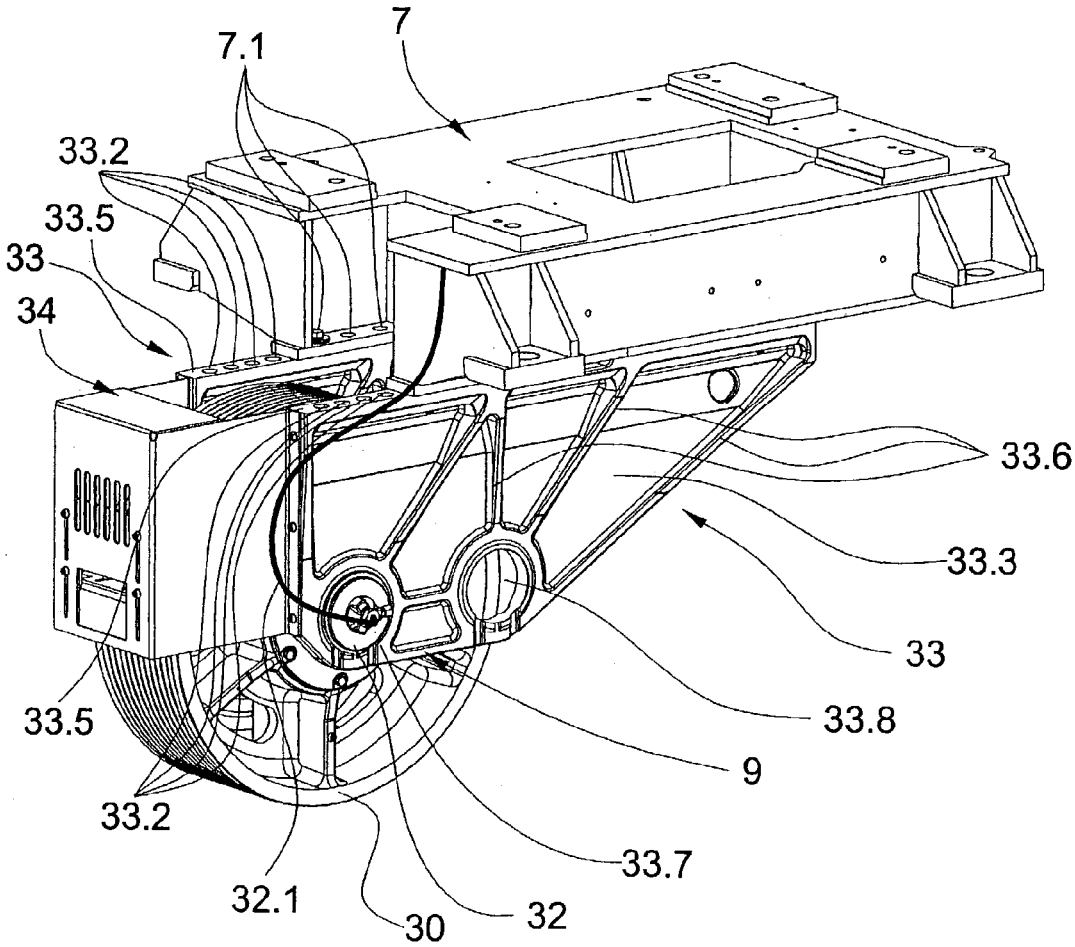
FIG. 2*a* is a view of the counter-roller support arranged on a machine frame.
Figure 2B:
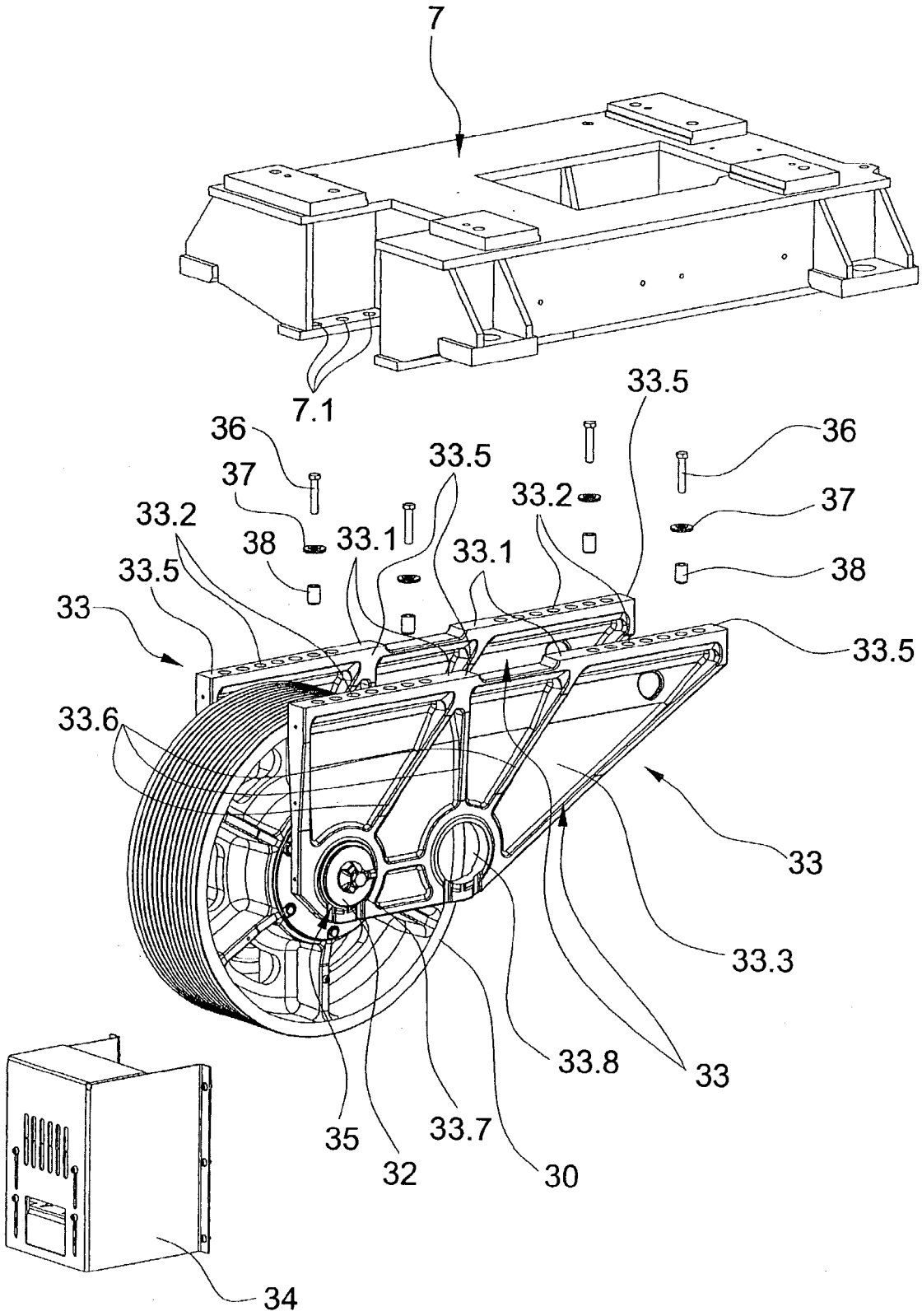
FIG. 2*b* is an exploded view of the counter-roller support and machine frame of FIG. 2*a*.
Figure 2C:
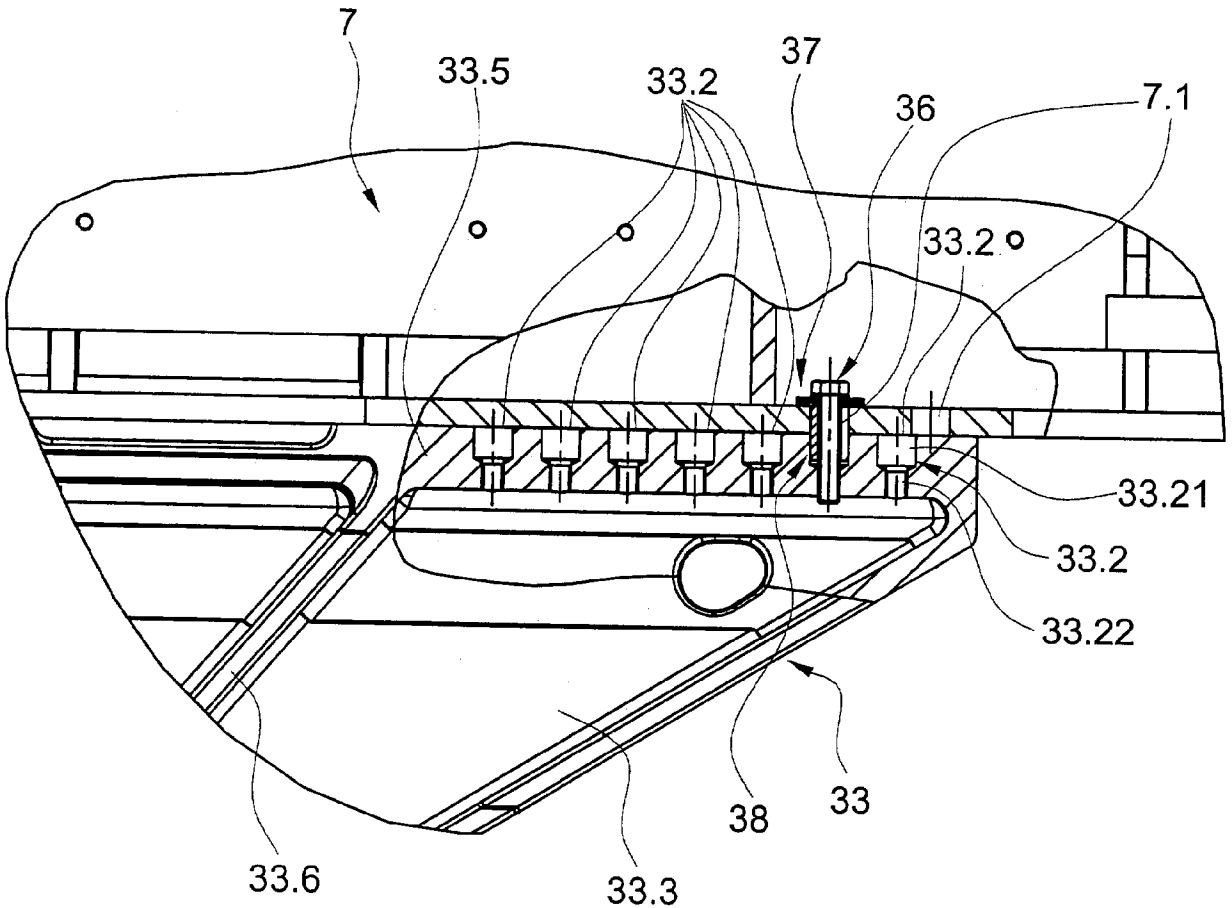
FIG. 2*c* is a section view presenting details of the counter-roller support.

The construction of the counter-roller support 9 arranged on the engine frame is described in more detail in FIGS. 2*a* to 2*b*, whereby FIG. 2*a* is an assembled view of the subassembly and FIG. 2*b* is an exploded view of the subassembly. FIG. 2*c* shows details of the counter-roller support 9 arranged on the engine frame.

The counter-roller support 9 comprises a carrier element 33 on each side of the counter-roller 30 and a casing 34. The counter-roller 30 has its axle 32 extending on both sides through location holes 33.7 of the carrier element 33, and is secured axially by means of shaft safety rings 35. An extension for the lubrication of the axle 32 is designated 32.1. A further location hole 33.8 is provided in each carrier element 33, which are identical. Each carrier element 33 includes a plate 33.3 having a headliner 33.5, whereby ribs 33.6 are provided for reinforcement. The headliner 33.5 provides a contact surface 33.1 with a number of two-stage bore holes 33.2, which serve for fastening the counter-roller support 9 to the bottom side of the engine frame 7. The upper portion 33.21 (see FIG. 2*c*) of the bore-hole 33.2 is cylindrical, the lower portion 33.22 is equipped with a thread. The engine frame 7 has at its bottom side a number of cylindrical bore holes 7.1. Bolts 36 with washers 37 connect the carrier elements 33 to the engine frame 7. Clamping sleeves 38 are not only arranged in the cylindrical portion 33.21 of the bore-hole 33.2, but also in the bore-hole 7.1 and take up shearing force. The number of bore-holes 33.2 and 7.1 is selected such that the counter-roller support 9 can be fastened to the engine frame in different positions, according to the required cable-line spacing between the elevator car and counterweight. A casing 34 protects the counter-roller from contact and prevents jumping of the cables on the counter-roller 30.

As further shown in FIG. 2*c*, a number of two-stage bore-holes 33.2 are arranged on the headliner 33.5, whereby the spacing of the bore holes 33.2 determines the adjusting raster or fineness of adjustment available for the positioning of counter-roller support 9. The adjusting raster can be further refined by providing at least a further bore-hole 7.1 in the machine framework 7.

The illustrated embodiment shows a left hand side overhang of the counter-roller support 9, and thus the counter-roller 30. The engine frame can also be provided with a number of bore-holes 7.1 so that a right hand side overhang of the counter-roller support 9, and counter-roller 30 is possible.

We claim:

1. An engine frame and counter-roller support assembly for an elevator drive, comprising an engine frame, a counter-roller support having a pair of spaced identical carrier elements each comprising a plate with ribs for reinforcement thereof and at least one headliner with a plurality of aligned bore holes, a counter-roller supported by the carrier elements, and mounting means comprising the headliner bore-holes a corresponding bore-hole at a bottom side of the engine frame and a mounting bolt in one of the headliner bore holes and the corresponding engine frame bore-hole for joining the carrier elements to the engine frame at a chosen one of a plurality of positions whereby a required cable-line spacing between an elevator car and a counterweight can be obtained.

2. The assembly according to claim 1, wherein the headliner bore holes are of a two-stage construction, having an upper cylindrical portion and a threaded lower portion.

3. The assembly according to claim 1 or 2, wherein the headliner bore-holes have a spacing distance defining an adjusting raster for the counter-roller support, and the engine frame has at least two boreholes alternately alignable with a headliner bore-hole.

4. The assembly of claim 2 further comprising a clamping sleeve mounted in the engine frame bore-hole and cylindrical part of the headliner bore-hole with the mounting bolt.

5. The assembly of claim 3 further comprising a clamping sleeve mounted in the engine frame bore-hole and cylindrical part of the headliner bore-hole with the mounting bolt.

* * * * *